US008128303B2

(12) United States Patent
LaFlamme et al.

(10) Patent No.: US 8,128,303 B2
(45) Date of Patent: Mar. 6, 2012

(54) METERING DISPENSING FLEXIBLE POUCH WITH SPRAY NOZZLE

(75) Inventors: Roger J. LaFlamme, Enfield, CT (US); Christopher S. Nesbitt, Worcester, MA (US)

(73) Assignee: Sealed Air Corporation (US), Elmwood Park, NJ (US)

( * ) Notice: Subject to any disclaimer, the term of this patent is extended or adjusted under 35 U.S.C. 154(b) by 1063 days.

(21) Appl. No.: 12/026,608

(22) Filed: Feb. 6, 2008

(65) Prior Publication Data

US 2008/0193198 A1 Aug. 14, 2008

Related U.S. Application Data

(60) Provisional application No. 60/889,075, filed on Feb. 9, 2007.

(51) Int. Cl.
*A46B 11/02* (2006.01)

(52) U.S. Cl. ..... 401/188 R; 401/137; 222/383.1

(58) Field of Classification Search ..... 401/188 R, 401/190, 137–139; 222/372, 373, 383.1
See application file for complete search history.

(56) References Cited

U.S. PATENT DOCUMENTS 0,886,984 A 5/1908 Jopling (Continued)

FOREIGN PATENT DOCUMENTS

DE 4030851 4/1992

(Continued)

OTHER PUBLICATIONS

Stephen & Lawyer, Inc., Reticulated Foam, http://www.steplaw.com/reticulatedfoam.html.

(Continued)

*Primary Examiner* — David Walczak

(74) *Attorney, Agent, or Firm* — St. Onge Steward Johnston & Reens LLC

(57) ABSTRACT

An atomizing fluid dispenser for delivering, via a spray nozzle, a substantially equal metered dose of fluid material for each dispensing operation. The fluid dispensing device includes a container with an interior fluid storage region therein. A metering housing, when depressed, generates a one-way flow from the interior fluid storage region of the container that serves to fill the predetermined volume of the chamber within the metering housing. When the metering housing is depressed a second time a substantially equal volume of fluid is dispensed from the container, while upon release, the metering housing is refilled by drawing fluid from the fluid storage region. A spray nozzle or atomizer is attached to the exit port of the dispensing device so that the liquid is delivered in metered fashion in spray form.

20 Claims, 5 Drawing Sheets

U.S. PATENT DOCUMENTS 1,217,054 A 2/1917 Pearman
1,941,745 A 1/1934 Higley
2,714,475 A 8/1955 Roehrich
2,855,127 A 10/1958 Lerner et al.
3,223,289 A 12/1965 Bouet
3,396,419 A 8/1968 Richter et al.
3,617,139 A 11/1971 Ross
3,949,137 A 4/1976 Akrongold et al.
3,981,106 A 9/1976 Gallo
4,004,854 A 1/1977 Breer, II
4,074,944 A 2/1978 Xavier
4,098,434 A 7/1978 Uhlig
4,124,316 A 11/1978 O'Rourke
4,127,515 A 11/1978 MacRae et al.
4,188,989 A 2/1980 Andersen
4,702,397 A 10/1987 Gortz
4,753,006 A 6/1988 Howe
4,760,642 A 8/1988 Kwak
4,809,432 A 3/1989 Schauble
4,886,388 A 12/1989 Gulker et al.
4,888,868 A 12/1989 Pritchard
4,889,441 A 12/1989 Tice
4,890,744 A 1/1990 Lane, Jr. et al.
4,993,594 A 2/1991 Becker et al.
5,014,427 A 5/1991 Byrne
5,016,351 A 5/1991 Drahus
5,074,765 A 12/1991 Pekar
5,114,255 A 5/1992 Villarreal
5,168,628 A 12/1992 Mock et al.
5,176,510 A 1/1993 Nilsson
5,261,570 A 11/1993 Hippely et al.
5,265,772 A 11/1993 Bartasevich et al.
5,303,851 A 4/1994 Libit et al.
5,337,478 A 8/1994 Cohen et al.
5,353,961 A 10/1994 Debush
5,356,039 A 10/1994 Christine et al.
5,372,487 A 12/1994 Pekar
5,387,207 A 2/1995 Dyer et al.
5,441,345 A 8/1995 Garvey et al.
5,482,980 A 1/1996 Pcolinsky
5,505,341 A 4/1996 Gueret
5,555,673 A 9/1996 Smith
5,564,190 A 10/1996 Fleetwood
5,640,737 A 6/1997 Boggs
5,700,245 A 12/1997 Sancoff et al.
5,701,674 A 12/1997 Mitchell
5,704,723 A 1/1998 Salisian
5,761,813 A 6/1998 Frick et al.
5,836,482 A 11/1998 Ophardt et al.
5,842,607 A 12/1998 Snider
5,855,066 A 1/1999 Manger
5,865,554 A 2/1999 Lin
5,934,296 A 8/1999 Clay
5,944,032 A 8/1999 Masterson
5,950,928 A 9/1999 Giang et al.
5,983,500 A 11/1999 da Silva
6,183,154 B1 2/2001 Coe
6,210,064 B1 4/2001 White et al.
6,251,098 B1 6/2001 Rake et al.
6,302,607 B1 10/2001 Burrowes et al.
6,394,316 B1 5/2002 Daansen
6,394,683 B1 * 5/2002 Pao ..... 401/289
6,406,207 B1 6/2002 Wiegner et al.
6,419,118 B1 7/2002 Rees et al.
6,558,629 B1 5/2003 Davidson
6,623,201 B2 9/2003 Brumlik
6,629,799 B2 10/2003 Flores, Jr.
6,641,307 B2 11/2003 Matsuda et al.
6,715,952 B1 4/2004 Aiken et al.
6,754,958 B2 6/2004 Haws et al.
6,789,321 B2 9/2004 Simms
6,789,706 B2 9/2004 Abergel et al.
6,843,368 B1 1/2005 Frutin
6,883,563 B2 4/2005 Smith
6,886,254 B1 5/2005 Pennella
6,910,274 B1 6/2005 Pennella et al.
6,925,716 B2 8/2005 Bressler et al.
6,929,155 B1 8/2005 Sayers
6,964,097 B2 11/2005 Franzini et al.
6,996,908 B2 2/2006 Orloff et al.
7,043,841 B2 5/2006 Franzini et al.
7,121,754 B2 10/2006 Bressler et al.
7,137,203 B2 11/2006 Bressler et al.
7,137,531 B2 11/2006 Arghyris et al.
7,156,132 B2 1/2007 O'Dougherty et al.
7,159,742 B2 1/2007 Lee
7,682,097 B2 * 3/2010 Knopow et al. ..... 401/136
2001/0025859 A1 10/2001 Dumont
2001/0025860 A1 10/2001 Auer
2002/0085873 A1 7/2002 Katsandres et al.
2003/0077106 A1 4/2003 Weihrauch
2003/0121936 A1 7/2003 De Laforcade
2004/0092864 A1 5/2004 Boehm, Jr. et al.
2004/0140326 A1 7/2004 Smart et al.
2004/0177510 A1 9/2004 Pennella
2004/0178284 A1 9/2004 Fahy et al.
2005/0138814 A1 6/2005 Pennella et al.
2005/0144785 A1 7/2005 Bressler et al.
2005/0199651 A1 9/2005 Laflamme et al.
2006/0072858 A1 4/2006 Kurosawa et al.
2006/0150386 A1 7/2006 Wanli et al.
2006/0254056 A1 11/2006 Coffin et al.
2006/0255068 A1 11/2006 Genosar
2006/0272154 A1 12/2006 Brevard
2007/0017098 A1 1/2007 Bressler et al.
2007/0084058 A1 4/2007 Szczepanowski et al.
2007/0214646 A1 9/2007 Bezdek

FOREIGN PATENT DOCUMENTS

DE 29719331 12/1997
DE 29818058 1/1999
FR 2628394 A1 9/1989
FR 2683759 11/1991
GB 2083142 A 3/1982
JP 6293348 10/1994
JP 10165668 6/1998
JP 2005199020 7/2005
WO 0176972 A1 10/2001
WO 0176974 A1 10/2001
WO 02071907 A1 9/2002
WO 2004096504 11/2004
WO 2005086852 A2 9/2005

OTHER PUBLICATIONS

3M Worldwide, Scotch-Brite Urethane Laminate 325HK 5 Pieces/Pack 72 Packs/Case, http://products3.3m.com/catalog/hk/en009/home_leisure/-/node_H16XQM6PDVgs/root_B . . . .

Plastic Bags for You, Pouch (zipper & non zipper), flat pouch, stand up pouch, with and without valve, with and without window, plain & preprinted, paper bag, etc., http://plasticbagsforyou.com/PRODUCTS/pouch-group.html.

* cited by examiner

METERING DISPENSING FLEXIBLE POUCH WITH SPRAY NOZZLE

CROSS-REFERENCE TO RELATED APPLICATIONS

This application is related to and claims priority from earlier filed U.S. Provisional Patent Application No. 60/889,075 filed Feb. 9, 2007.

BACKGROUND OF THE INVENTION

This invention relates generally to product packages that include integrated dispensing devices. More specifically, the present invention relates to product packages containing fluid media that include metering dispensing devices that can controllably dispense the fluid media from the product package containing the fluid media.

Various types of fluid material and media are employed for different purposes throughout commerce and industry. For example, there are various products in the areas of personal care, home care, air care, transportation care and food industries that require a fluid material to be dispensed in some manner from a source of such material.

Further, when this material is sold in commerce, it must be contained and stored in some type of container while awaiting use. Ultimately, when that product is used, it must be dispensed from its storage container to the desired location for use.

In the prior art, there are many different types of dispensers that are employed for the delivery of a stored fluid material to their desired location for use. For example, a storage container having a flexible body with a nozzle tip extending therefrom is commonly provided for such a purpose. An example of such use can be seen in the context of a ketchup dispenser, where a user squeezes the container body to urge the fluid material (ketchup) out from container body and through the nozzle tip to accurately deposit the fluid material at the desired location. In such an application, the amount of fluid that is ultimately delivered is determined by the how much the user actually squeezes the container body. While this method has provided marginally acceptable results, this method also typically yields an erratic fluid volume since more or less fluid material may be delivered on each successive squeeze of the container body. Also, the container must be held upright to avoid leakage because no valves are employed in the fluid nozzle tip.

In another example of a prior art dispensing device, a flexible container is provided that holds a volume of fluid material to be delivered. In an attempt to overcome the leakage issue noted above, a single one-way check valve is provided at the exit port of the flexible container. When the flexible body is squeezed, the material is urged out under pressure through the valve. The difficulty here is that the valve over time becomes partially clogged thereby requiring that the user apply additional pressure to cause the valve to open. As a result, once the valve opens, the additional pressure causes more fluid material to be deposited than the user typically would have desired.

In addition to the above noted need for simply dispensing a volume of fluid material, there is also a desire for the ability to immediately apply the dispensed fluid material, such as to a surface. In the prior art, the solution was to provide squeezable container bodies that are equipped with some type of applicator head for this purpose. For example, in the personal care industry, body wash devices commonly include some type of squeezable container body and an abrasive applicator material, such as fabric or foam, applied to the output port thereof. Thus, when the fluid material is dispensed to the exterior of the container body, it is dispensed onto the applicator and the applicator assists in spreading the material on the body of the user providing a better and more even distribution thereof. Applicators are particularly useful for even distribution in personal care industry, such as for applying shoe polish, to ensure a quality even and smooth coat.

In addition to the provision of applicator disposed at the outlet of the container, there have been attempts in the prior art to provide a dispenser that can easily deliver fluid material to an applicator that is positioned about the entire exterior surface of a container body. These prior art devices employ, for example, spring-loaded buttons that open an exit port in the main container body to permit flow of the fluid contained therein to an outer applicator material layer. This is in contrast to requiring the user to squeeze the entire body of the container. However, these devices are incapable of delivering a substantially equal dose of fluid with each dispensing operation because they simply open up the container body and permit the fluid to flow into the surrounding applicator material by gravity. Further, this construction requires that the fluid material exit through an opening at a lower side of the container. Therefore, it is not possible to dispense fluid on more than one side of the container or in a direction opposite to that of gravity. To dispense fluid material without concern for gravity, squeezable container bodies must be employed in connection with all of the disadvantages, as described above.

In view of the foregoing, the fluid dispensing and devices of the prior art suffer from various disadvantages that make them difficult and awkward to use. Further, these prior art dispensers often provide a user with unexpected results. Therefore, there is a need for a fluid dispenser that is easy to operate. There is a further need for a fluid dispenser that is capable of delivering a metered dose of fluid with each dispensing operation in order to produce predictable flow and a better application of the fluid material. There is also a need for such a dispenser that can operate independent of gravity. There is an additional need for the fluid to be capable of being delivered in a manner that allows the fluid to exit at any point on the surface of container. There is still a further need for a dispenser to include an applicator that facilitates even distribution and even application of the fluid material, as desired. Many of these needs are met by commonly owned, co-pending U.S. patent application Ser. No. 11/074,817, filed on Mar. 8, 2005 and U.S. patent application Ser. No. 11/951,351, filed on Dec. 6, 2007, which are incorporated herein by reference. This application sets forth a device for dispensing liquids in a metered fashion and provides for an exit port that can be located at any position on the fluid container. However there is still a further need to controllably deliver fluid from the exit port, namely, in an atomized or spray form.

BRIEF SUMMARY OF THE INVENTION

In this regard, the present invention preserves the advantages of prior art dispensing devices. In addition, the present invention provides new advantages not found in currently available devices and overcomes many disadvantages of such currently available devices. The present invention is generally directed to a novel and unique atomizer dispenser for delivering, via a spray nozzle, a substantially equal metered dose of fluid material for each dispensing operation.

The main flexible pouch and metering mechanism employed within the present invention is substantially similar to that found in the above noted U.S. patent application Ser. Nos. 11/074,817 and 11/951,351. The fluid dispensing device includes a container with an interior fluid storage region therein. A metering housing, having a preferably flexible construction, is disposed in fluid communication with the fluid storage region and a first one-way valve is disposed between the container and the flexible metering housing. When the flexible metering housing is depressed and released a vacuum action generates a one-way flow from the interior fluid storage region of the container that serves to fill the predetermined volume of the chamber within the metering housing. A second valve, in fluid communication with the metering housing output port, permits one-way fluid flow from the metering chamber to the exterior outer region of the container when the metering housing is depressed again. Each time the metering housing is depressed a substantially equal volume of fluid is dispensed from the container, while upon release, the metering housing is refilled by drawing fluid from the fluid storage region.

Further, in the context of the present invention, a spray nozzle or atomizer is attached to the exit port of the dispensing device after the second valve so that the liquid is delivered in metered fashion in spray form. It is also possible that the neck of the atomizer may be flexible to facilitate dispensing of the fluid.

It is therefore an object of the present invention to provide a fluid dispensing device that can deliver a substantially equal volume of fluid material in spray form from each dispensing operation. It is also an object of the present invention to provide a fluid dispensing device with a spray nozzle that is insensitive to gravity. It is a further object of the present invention to provide a metered fluid dispensing device that includes a spray applicator to ensure desired delivery of the fluid material. It is still a further object of the present invention is to provide a fluid dispensing device that can deliver spray flow at any point from the device. Finally, it is an object of the present invention to provide a fluid dispensing device that can deliver spray flow at multiple locations from the device.

These together with other objects of the invention, along with various features of novelty that characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

In the drawings which illustrate the best mode presently contemplated for carrying out the present invention.

DETAILED DESCRIPTION OF THE INVENTION

Figure 1:
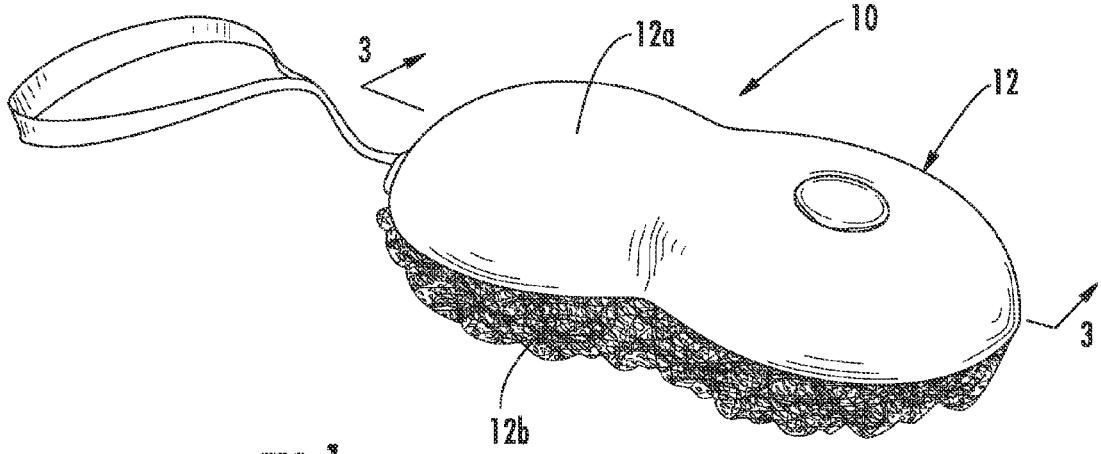
FIG. 1 is a top perspective view of the dispensing device of the present invention.
Figure 2:
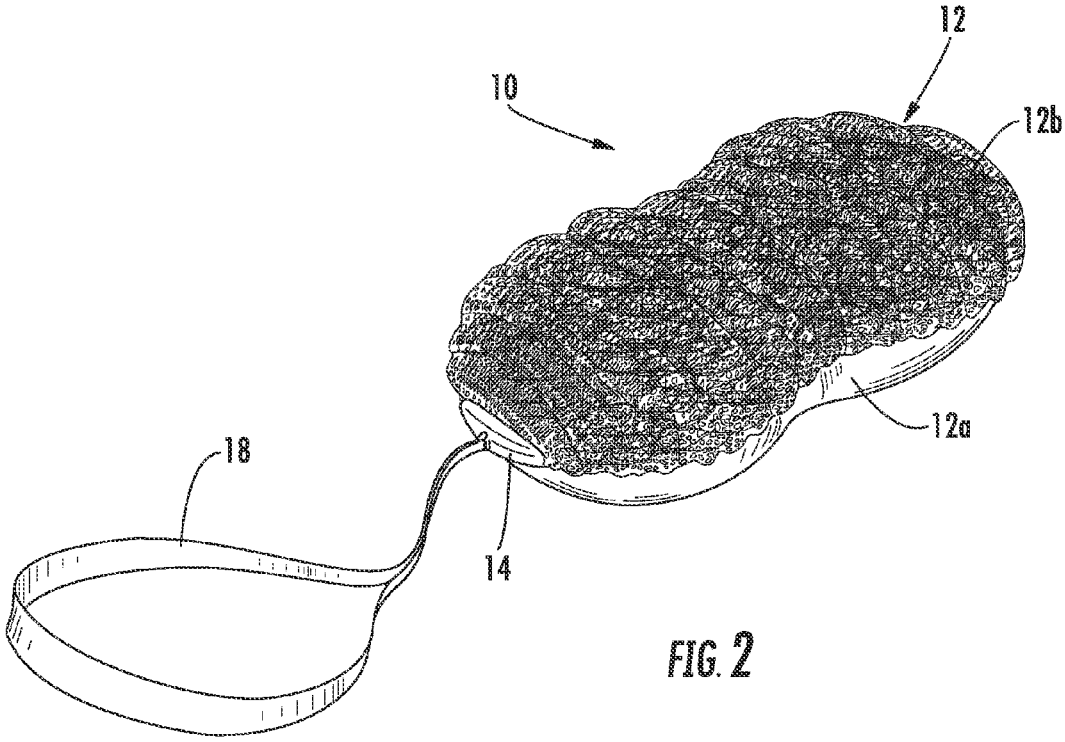
FIG. 2 is a bottom perspective view of the dispensing device of the present invention.

Now referring to the drawings, the dispensing device of the present invention is shown and generally illustrated at 10 in the figures. As can be seen at FIGS. 1 and 2, the dispensing device 10 of the present invention is shown to include an outer covering, generally referred to as 12, which serves as an applicator material. This applicator material 12 can be formed of any type of material to suit the application at hand. For example, as seen in FIGS. 1 and 2, the outer covering 12 is preferably formed from of two different types of material 12*a*, 12*b* allowing it to serve two purposes when in use. Preferably, the top section 12*a* is of a foam material while the bottom section 12*b* is of a mesh or "pouf" material. The top section 12*a* can be secured to the bottom section 12*b* by, for example, welding. A snap-fit cover 14 seals a re-fill port 16, as will be described in more detail in connection with FIG. 3. A hang strap or cord 18 can also be provided. The configuration of the outer cover 12 applicator material is just one of many different types of applications of the present invention which will be discussed in more detail below.

Figure 3:
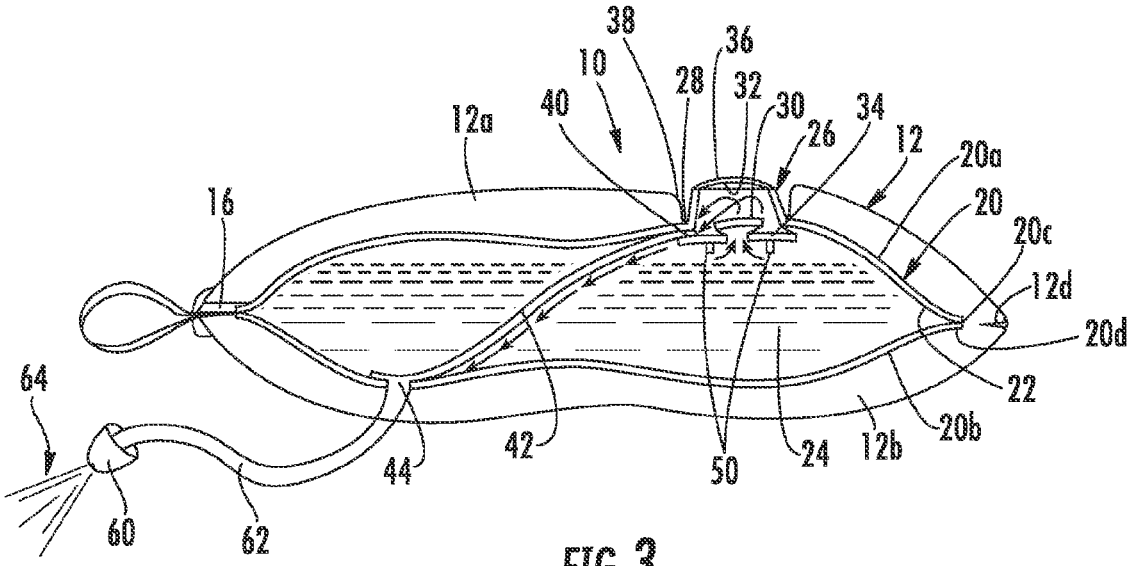
FIG. 3 is a cross-sectional view through the line 3-3 of FIG. 1.

Turning now to FIG. 3, a cross-sectional view through the line 3-3 of FIG. 1 is shown to illustrate the internal construction of the dispensing device 10 of the present invention. A container body 20 is provided which includes a fluid storage region 22 that contains a volume of fluid material 24 therein. The container 20 is preferably made of a flexible material, such as plastic or nylon. Thus, as fluid material 24 is evacuated from within the container body 20, it will collapses gradually for a compact structure.

A metering housing 26 is provided at a first opening 28 of the container body 20. The metering housing 26 includes an intake one-way valve 30, such as a check valve, to pull fluid 24 from the fluid storage region 22 of the container body 20 into a metering chamber 32 of a predetermined size. Any type of valve can be used to suit the given application. The intake valve 30 is positioned in a base plate 34 of the metering housing 26. Thus, fluid 24 can only flow in one way from the fluid storage region 22 into the metering chamber 32. The metering chamber 32 is defined by a flexible membrane 36 in the form of a button or bulb that is accessible and manipulateable through a gap 38 in the applicator material 12. The button 36 is preferably clear to provide an indicator to the consumer when the metered dosage of fluid material 24 is ready for delivery.

An output valve 40 is provided in fluid communication with the metering chamber 32 of the metering housing 26. Thus, the fluid residing in the metering chamber can only exit through the output valve 40. Also, a fluid conduit 42 is provided to direct the exit of fluid 24 at any location through the container body. Preferably, as seen in FIG. 3, the fluid conduit 42 connects the output valve 40 of the metering housing 26 to an exit or output port 44 located on the bottom of the container body. This permits the metering housing 26 to be on an opposite side as the side through which the fluid 24 exits. The fluid conduit 42 can be directed and located to exit at any point through the container body 20 depending on the application at hand. Also, the output valve 40 may be located at the exit port 44, as an alternative depending on the requirements of the application.

In accordance with the metering dispensing flexible pouch with spray nozzle of the present invention, a spray nozzle member 60 is attached to the exit port 44. The spray nozzle 60 may be installed directly into the exit port 44 or may be installed at the end of a leader tube 62 to allow the user additional directional control of the fluid 24 dispensed by the nozzle 60. It can also be appreciated by one skilled in the art that the exit port 44 can be located anywhere on the dispensing device 10, as is shown below in FIGS. 7 and 8. Also, the spray nozzle 60 can be of any configuration that can deliver the liquid in a spray or atomized form. The spray nozzle 60 can be modified to provide different type of spray shapes and densities, according to the application desired and type of liquid being dispensed. Further, the spray nozzle 60 can be provided with an adjustment feature to allow the end user to adjust the spray pattern 64 with each use if desired and the leader tube 62 may be rigid or flexible.

In accordance with the present invention, each press of the flexible membrane 36 causes a metered amount of liquid 24 to be forced through the spray nozzle 60 to provide the desired atomized delivery application. This button/membrane 36 can be placed anywhere on the device, as needed. Further, the main pouch can be of any configuration, such as a flat pouch or stand up pouch (SUP), for example. In addition, further layers can be provided, such as laminations of foam, fabric, paper, plastic, and the like, to enhance the touch and appearance of the overall device.

Still referring to FIG. 3, the operation of the dispensing device 10 is further explained which is applicable to the present invention which includes a spray nozzle 60 attached to a leader tube 62 that extends from the exit port 44. The button 36 of the metering housing 26 is depressed to initiate a vacuum operation. More specifically, when the button 36 is further released, fluid 24 is pulled from the fluid storage region 22 of the container body 20 into the metering chamber 32 which is configured to be of a certain known volume. The act of releasing the button 36 fills the metering chamber 32 to substantial capacity. Thus, a metered amount of fluid material 24 is contained within the metering chamber 32 in preparation for delivery. The size of the metering chamber 32 can be selected according to the type of fluid material 24 to be dispensed, the application therefor and the desired dosage volume.

A further depression of the button 36 urges the measured volume of fluid 24 within the metering chamber 32 to exit out through the output valve 40 of the metering housing 26. This known amount of fluid material 24 is then either directly routed to the applicator 12 for use or through a fluid conduit 42, as seen in FIG. 3, for more targeted introduction into the applicator 12. In this case, it is preferred that the metered volume of fluid material 24 be routed to the spray nozzle 60. The fluid exiting the spray nozzle 60 can then be directed onto a desired surface or back into the applicator 12 as indicated by the intended use.

Referring back to FIG. 1, an efficient method of manufacturing a quality dispensing device 10 is to employ heat welding to construct the container 20 and the applicator material 12 thereon. For example, a top portion 20*a* is typically heat welded to a bottom portion 20*b* about their periphery 20*c* to form a container 20 with an interior fluid storage region 22 therein. The applicator material 12 is similarly secured to the container 20 by heat welding or other similar process, such as gluing, either about its periphery or its entire contact surface with the container 20.

Figure 4:
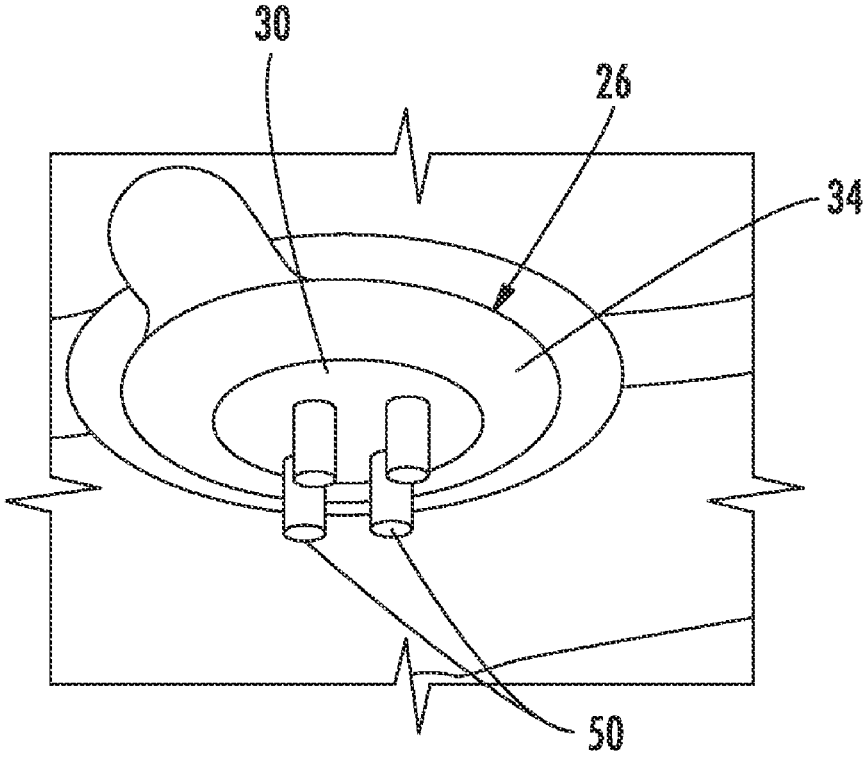
FIG. 4 is a close-up perspective view of the metering housing with stand-off legs.
Figure 5:
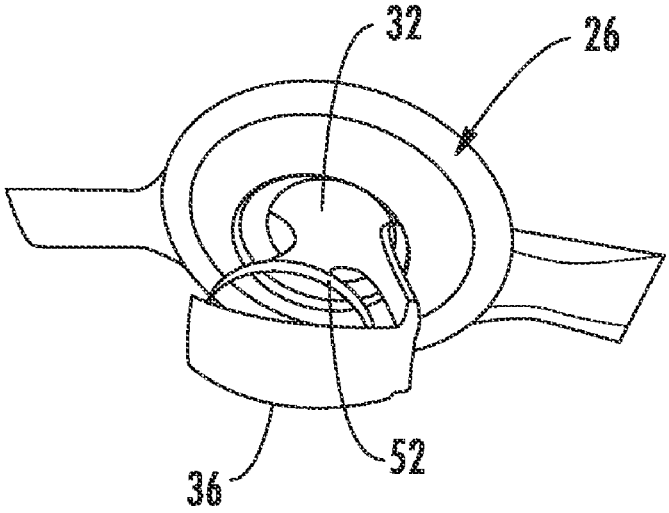
FIG. 5 is a close-up perspective view of the metering housing with coil spring.

Turning now to FIGS. 4 and 5, further enhancements to the metering housing 26 construction are shown in detail. As seen in FIG. 4, a number of stand-off legs 50 emanate downwardly from the base plate 34 of the metering housing 26. These legs 50 prevent the base plate 34 from completely bottoming out against the container 20 wall thereby blocking flow of fluid material 24 into the intake valve 30. The stand-off legs 50 are particularly useful when the volume of fluid material 24 left in the container 20 is running low and the container 20 is becoming relative flat in configuration. In this situation, there is a possibility that the aforesaid bottoming out may occur. However, the use of the stand-off legs 50 of FIG. 4 prevent this from occurring.

FIG. 5 illustrates a further modification of the metering housing 26 to ensure that maximum suction is achieved and that the entire metering chamber 32 is filled upon each depression and release of the button 36. A spring-biasing structure 52 resides within the button or bulb structure 36 of the metering housing 26. Thus, the button 36 recovers quickly while providing a strong suction or vacuum to fill the interior of the metering chamber 32 with the desired metered volume of fluid material 24. A coil spring is preferred for the spring-biasing structure 52 but other spring-biasing structures, such as leaf springs and foam material may be employed for this purpose. Further, while various spring-biasing structures 52 are shown, it is also within the scope of the invention that the resiliency of the bulb structure 36 material is selected to exhibit sufficient memory to return to its original shape quickly without the need for spring-biasing structures 52. In this manner, the present invention clearly provides for an overall construction that requires dramatically less parts for operation as compared to the prior art conventional spray dispensers.

Figure 6:
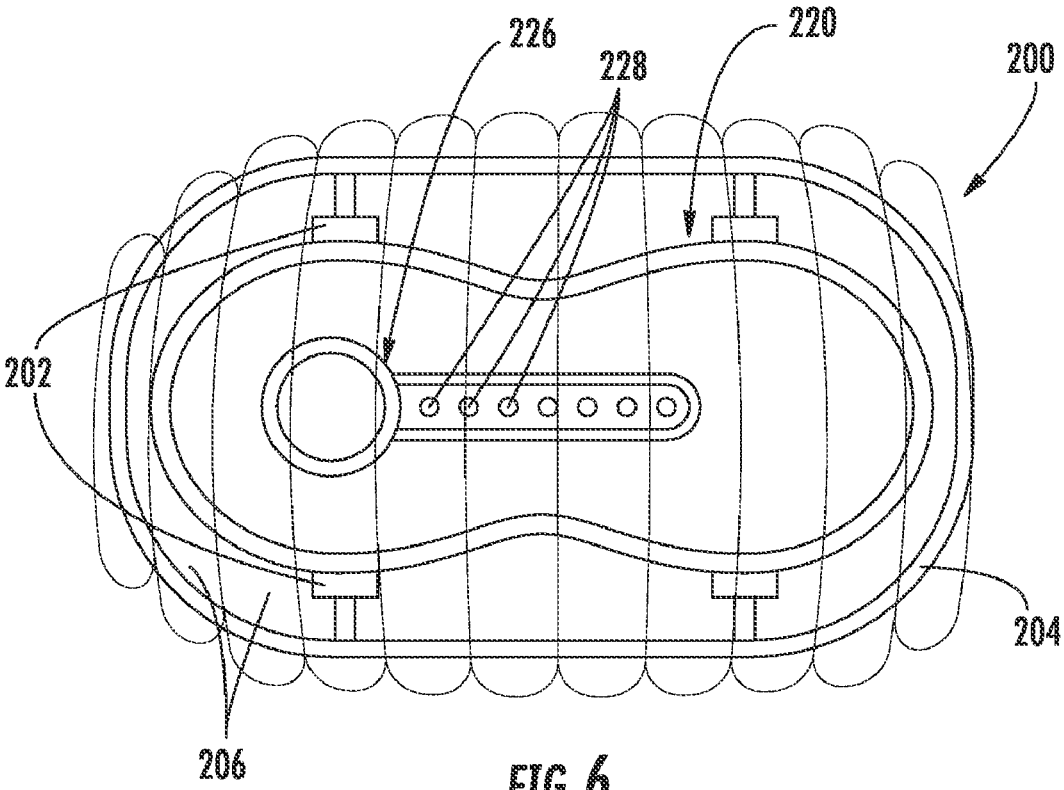
FIG. 6 is a top plan view of an alternative embodiment of the present invention.

FIG. 6 illustrates a further alternative embodiment 200 of the present invention where a container, such as container 220 or 20, includes a series of tabs 202 that emanate outwardly from the container 220. An outer frame or skeleton 204 is connected to the container 220 via the tabs 202. Applicator material 206, such as "poof" or fabric material, is then attached to the frame 204 with the container 220 residing therein. This embodiment 200 is particularly well-suited to permit free flowing of fluid material about the dispenser 200.

Figure 7:
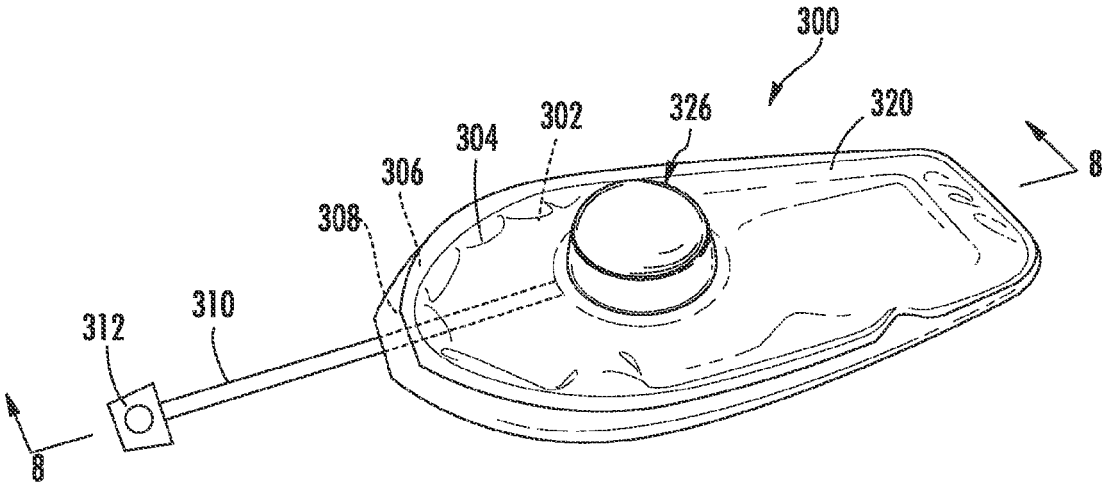
FIG. 7 is a front perspective view of another embodiment of the invention.
Figure 8:
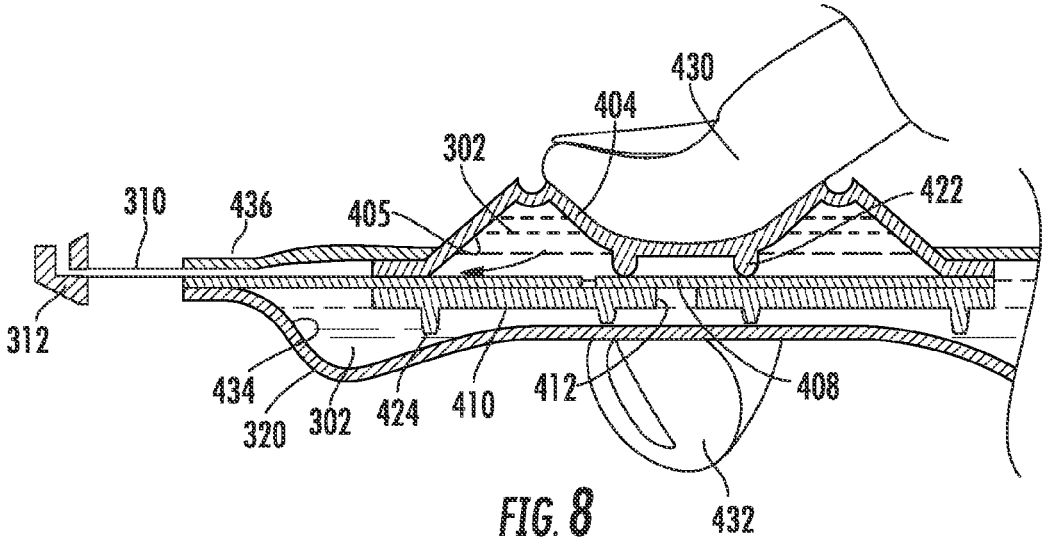
FIG. 8 is a cross-sectional view through the line 8-8 of FIG. 7.

Turning now to FIGS. 7 and 8, details are shown of a another alternate device 300 that includes the improved valving of the present invention that prevents inadvertent or accidental dispensing of liquid 302 even when pressure is placed on the dome pump 326 or storage container 320. FIG. 8 illustrates a perspective view of a metering dispenser 300 that employs the improved valving in accordance with the present invention. An outer storage container 320 is provided that may be formed of two sheets of material 304, 306 secured together, such as by welding, or a tube of material. A metering pump, generally referred to as 326, pulls liquid 302 from the storage container 320, meters it, and then dispenses it via an exit port 308 into a leader tube 310 and ultimately out of a spray nozzle 312.

In the dome pump 326 of the present invention, the base plate 410, through which the flow through aperture 412 passes, is preferably slightly convex, although it may be flat, if desired. Resting above the aperture 412 and within the cavity 405 of the dome is a flapper valve 408 of preferably thin film construction. It is possible that this flapper valve 408 be configured of a normally open condition but also may be configured to lie flat when at rest. As long as the plate 410 with the aperture remains convex, the flapper valve 408 does not seal against the aperture 412 such that any inadvertent contact with the flexible dome pump housing 404 does not result in the dispensing of the product. Instead, since the flapper valve 408 is open, liquid product residing inside the cavity 405 of the flexible pump housing 404 will tend to simply flow back through the inlet aperture 412 to the reservoir within the storage container itself, rather than flow undesirably out through the exit valve to outside of the dispenser 300. In use, if a person has the dispenser in their pocket or purse and pressure is accidentally or unintentionally placed on the flexible housing 404 of the dome pump 326, liquid will not flow outside the dispenser thereby preventing a mess from being made due to unintentionally dispensed product.

FIG. 8 illustrates intentional dispensing of liquid 302. When it is desired to actually dispense the liquid product 302, the user's thumb 430 can depress the flexible dome 404 and the user's index finger 432 can invert the base plate 410 from convex to concave, by application of force against the stand-off legs 424, such that flexible dome 404, with the assistance of the stand-off legs 422 under the flexible dome, securely seals and provides a positive lock of the flapper valve 408 over and about the aperture 412 thereby closing the liquid flow passage back into the reservoir 434 of the storage container 320. It is also possible that the base plate 410 is concave and then is inverted to a convex configuration. Other fingers of the user may be used to carry out this operation. Thus, the only path for the liquid 302 contained within the cavity 405 of dome 404 is to exit through the one-way outlet valve 436 for intended dispensing of the product, as indicated by the arrows in FIG. 8.

It should be understood that the stand-off legs 422 on the bottom of the flexible dome housing 404 and the stand-off legs 424 on the bottom of the base plate 410 can be modified in size, length and configuration to adjust the amount of squeezing necessary by the user's fingers 430, 432 to effectuate sealing of the flapper valve 408. For example, preferably four stand-off legs 422 are provided on the bottom of the flexible dome housing 404 in a 2×2 array and can be 1/32 of an inch in length. It is also possible that these stand-off legs 422 can be a single downwardly depending wall, such as in the shape of a circle or square. Such an array is configured to downwardly press against the one-way flapper valve 408 outside of the diameter of the aperture 412 through the base plate 410 to provide a good seal of the flapper valve 408 to the base plate 410.

The dispensing device 10 of the present invention has a wide array of applications of use to take advantage of the unique metered dosage capability of the present invention. Virtually any dispenser with any type of applicator material or combinations of applicator materials in different configurations can employ the present invention.

For example, the personal care industry has particular application in the controlled and metered dispensing of bath and shower gels. Also, medicines, cosmetics, hair care products, such a shampoos, skin care products, such as lotions, insect repellants and sunscreen products can employ the present invention. Also, various home products can be delivered in a device 10 according to the present invention. These include products for furniture cleaning and polishing, tub and shower cleaning, floor cleaning and polishing, window cleaning, odor elimination, oven cleaning, laundry cleaning and apparel treatment. Also, air treatment device can employ the present invention.

The device with a spray nozzle 60 of the present invention has particular application in dispensing liquid that is best suited for being sprayed or atomized for delivery. For example, the present invention is very well suited for dispensing air freshener, which is typical sprayed for delivery. As an advance over the prior art, the present invention provides controlled metering of the sprayed liquid, which is not found in the prior art.

Still further, cleaning products can be dispensed in a controlled fashion, such as those for cleaning cars, bikes, planes and trucks. The food industry has numerous potential applications, particularly for the dispensing of condiments, sauces and vitamins. These items can be sprayed as well.

To employ the dispensing device 10 of the present invention, the size and construction of the metering housing 26 as well as the positioning of where the fluid material 24 is delivered to the surface of the device can be easily modified to suit the given application. The materials used for the container 20 and the metering housing 26, while preferably flexible plastic, can be any suitable material for the application at hand. Also, the container 20 can be made of a different material than the metering housing 26.

The applicator material 12 can be foam, such as open cell foam, fabric, blended material, co-extruded material and combinations thereof. It should be understood that these materials are just examples of the types of materials that can be used in connection with the dispenser 10 of the present invention. The specific material is determined by the given application and the type of material to be dispensed. Non-woven materials or fibers may also be employed as the material for the applicator 12 on one or both sides of the device. For example, reticulated foam may also be employed. These materials would be well-suited as applicators 12 for more harsh chemicals, such as tire cleaner and paint remover where toughness is required. Also, more abrasive material can be provided on one side of the device for more aggressive cleaning, for example, while the opposing side has a polishing type surface. In general, the size, density and wicking action of the cells and overall size of the applicator 12 can be modified to suit the particular fluid to be applied.

Any type of spray nozzle 60 can be used to deliver the liquid in a spray form. The type shown on the attached invention disclosure is just one example of the type of spray nozzle 60 that can be used in the present invention.

In summary, a new and novel dispenser 10 is provided that can deliver consistent metered dosages such fluid material 24 in an atomized spray form. The dispenser 10 has a greatly improved construction where the fluid material 24 is even distributed throughout the applicator material 12 for a more efficient and more effective fluid dispensing. The dispenser includes a unique spray nozzle 60 to deliver the metered liquid in a spray form, which is new in the art.

It would be appreciated by those skilled in the art that various changes and modifications can be made to the illustrated embodiments without departing from the spirit of the present invention. All such modifications and changes are intended to be covered by the appended claims.

What is claimed:

1. A fluid dispensing device, comprising:

a flexible container having an interior fluid storage region therein and an opening extending from said interior fluid storage region to an exterior region outside the flexible container;

a flexible metering housing in the opening of the flexible container, having a metering chamber therein with a predetermined volume, disposed in fluid communication with the fluid storage region via the opening;

a first valve disposed between the container and the flexible metering housing to permit unidirectional fluid flow from the interior fluid storage region of the container into the metering chamber thereby filling the predetermined volume of the metering chamber;

a second valve, having an output port, in fluid communication with the metering housing and permitting unidirectional fluid flow of a volume of fluid substantially equal to the predetermined volume of the metering chamber from the metering chamber to the exterior region of the container; and a spray applicator in fluid communication with the output port to deliver liquid in a metered fashion in a spray form.

2. The fluid dispensing device of claim 1, further comprising:

means for dispersing fluid from the spray applicator about the exterior region of the container.

3. The fluid dispensing device of claim 2, wherein the means for dispersing is a layer of foam positioned about the container.

4. The fluid dispensing device of claim 2, wherein the means for dispersing is a layer of fabric positioned about the container.

5. The fluid dispensing device of claim 1, further comprising:

a fluid conduit having a first end and a second end, the fluid conduit connected at the first end to the output port and at the second end to the spray applicator.

6. The fluid dispensing device of claim 5, wherein the output port and the spray applicator are on opposing sides of the container from one another.

7. The fluid dispensing device of claim 5, wherein the fluid conduit is routed through the interior fluid storage region of the container.

8. The fluid dispensing device of claim 1, further comprising:

a fluid conduit disposed between the metering housing and the second valve.

9. The fluid dispensing device of claim 1, further comprising:

a refill port connected to the container.

10. The fluid dispensing device of claim 1, wherein the first valve and the second valve are one-way check valves.

11. The fluid dispensing device of claim 1, further comprising:

a strap connected to the container.

12. The fluid dispensing device of claim 1, further comprising:

standoff means connected to the metering housing, the standoff means being proximal to the first valve to prevent the first valve from being blocked.

13. The fluid dispensing device of claim 12, wherein the standoff means is at least one leg.

14. The fluid dispensing device of claim 12, wherein the standoff means is a spring.

15. The fluid dispensing device of claim 1, further comprising:

a frame attached to the container; and applicator material attached to the frame.

16. A method of dispensing a fluid, comprising:

providing a flexible container having an interior fluid storage region therein and an opening extending from said interior fluid storage region to an exterior region outside the container;

providing a volume of fluid within the interior fluid storage region;

providing a flexible metering housing in the opening of the flexible container, having a metering chamber therein with a predetermined volume, disposed in fluid communication with the fluid storage region via the opening;

providing a first valve disposed between the container and the flexible metering housing to permit unidirectional fluid flow from the interior fluid storage region of the container into the metering chamber;

providing an exit port in fluid communication with the metering chamber with a second valve disposed between the exit port and the metering chamber;

providing a spray member in fluid communication with the exit port;

depressing the flexible metering housing;

releasing the flexible metering housing;

filling the metering chamber with a volume of fluid by vacuum force in an amount substantially the same as the volume of the metering chamber;

depressing the flexible metering housing again; and spraying the volume of fluid within the metering chamber through the exit port via the second valve and the spray member.

17. The method of claim 16, further comprising the step of:

dispersing fluid that has exited through the spray member proximal to the exterior region of the container.

18. The method of claim 16, further comprising the step of:

providing a fluid conduit connected at a first end to the exit port and at a second end to the spray member; and routing fluid from the exit port and out through the spray member.

19. The method of claim 18, wherein the fluid conduit is positioned through the interior fluid storage region of the container.

20. The method of claim 16, further comprising the step of:

preventing the first valve from being blocked.

* * * * *